US006016911A

United States Patent [19]

Chen

[11] Patent Number: 6,016,911

[45] Date of Patent: Jan. 25, 2000

[54] PACKAGE FOR A REEL OF WIRE

[76] Inventor: Hua-Mei Chen, 2 Fl., No. 4, Alley 8, Lane 38, Section 2, Nankang Rd., Taipei, Taiwan

[21] Appl. No.: 09/253,044

[22] Filed: Feb. 19, 1999

[51] Int. Cl.[7] ..... B65D 85/04

[52] U.S. Cl. ..... 206/395; 206/409; 206/459.1; 229/117.24; 229/151; 242/170

[58] Field of Search ..... 206/389, 395–397, 206/408, 409, 459.1; 229/151, 167, 117.24; 242/159, 160.1, 164, 165, 170, 171

[56] References Cited

U.S. PATENT DOCUMENTS

| | | | |
|---|---|---|---|
| 2,579,131 | 12/1951 | Tinsley | 206/409 |
| 2,580,900 | 1/1952 | Epstein | 206/409 |
| 2,713,938 | 7/1955 | Snyder | 206/395 |
| 2,930,479 | 3/1960 | Lowe | 206/397 |
| 2,974,850 | 3/1961 | Mayer | 206/408 |
| 3,161,289 | 12/1964 | Leysen | 206/395 |
| 3,390,844 | 7/1968 | Dillow et al. | 206/395 |
| 3,541,052 | 11/1970 | Kirk | 206/395 |
| 3,826,420 | 7/1974 | Bamburg et al. | 229/151 |

*Primary Examiner*—Jim Foster
*Attorney, Agent, or Firm*—Bacon & Thomas, PLLC

[57] ABSTRACT

The invention relates to a package for a reel of wire. The package has a cover, a connecting plate foldably connected with the cover and a bottom foldably connected with the connecting plate. The cover, the connecting plate and the bottom are able to be assembled into a package such that a reel of wire is able to be received therein and a free end of the reel of wire is able to extend through an outlet on a top face of the cover for operation and the free end is able to be retained by inserting into a retaining hole on the top face of the cover. Furthermore, a window defined on the top face of the cover enables an operator to see the volume of the reel of wire left in the package.

4 Claims, 5 Drawing Sheets

PACKAGE FOR A REEL OF WIRE

FIELD OF THE INVENTION

The present invention relates to a package, and more particularly to a package for receiving a reel of wire therein. The package is easy to be assembled and operated by an operator in any environment.

BACKGROUND OF THE INVENTION

Wires are usually stored in different sizes of reels. When shipment of the wires are required, a membrane of plastic is used to cover the outer periphery of the reel so as to protect the outer periphery of the wire from any kind of damage. When the wire is used, an operator will have to tear off the plastic membrane to reveal the free end of the wire. However, after the wire is used, because the plastic membrane has been tom off previously, the reel of wire will not be able to maintain its original shape. Therefore, the conventional reel of wire is often randomly disposed or boxed. Using a plastic membrane to wrap up a reel of wire is useful in protection, but it is not helpful in operation and transportation thereof Therefore, an improvement to the conventional package for the reel of wire is earnestly required so as to save time in transportation and facilitate the use and store thereof.

SUMMARY OF THE INVENTION

The main object of the invention is to provide a package for a reel of wire. The package has a window defined on a top face thereof for the convenience of observation by an operator to see how much of the wire is left therein. Furthermore, an outlet and a retaining hole are defined on the top face thereof such that a free end of the wire is able to extend out through the outlet for operation and is able to be stored by inserting into the retaining hole, thereby maintaining the shape of the reel after operation.

Another object of the invention is to provide a package which is able to be assembled easily, and is able to be stacked easily for transportation.

BRIEF DESCRIPTION OF THE DRAWINGS

The present invention will be better understood with the following drawings, wherein.

DETAILED DESCRIPTION OF THE PREFERRED EMBODIMENT

Figure 1:
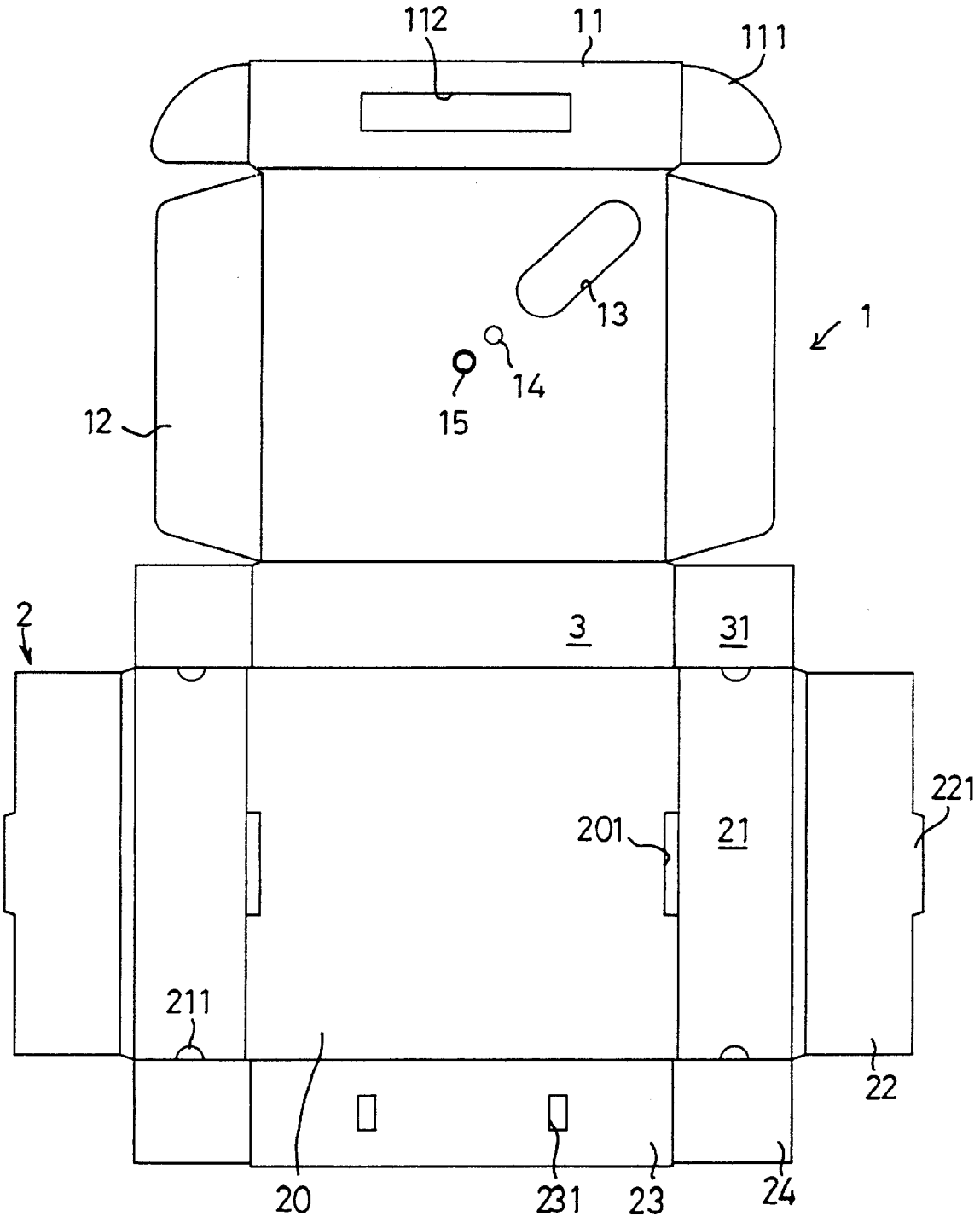
FIG. 1 is a top plan view of a package of the invention, wherein the package is fully expanded.

As shown in FIG. 1, a paper board layout for a package in accordance with the invention is shown. The paper board is divided into two major parts: a cover (1) and a bottom (2). The cover (1) is foldably connected with the bottom (2) via a connecting plate (3), and has a first front side (11) having a pair of opposite first ears (111) formed on two opposed sides thereof and a slot (112) defined in a mediate portion thereof, and has a pair of first wings (12) foldably connected thereto. The connecting plate (3) being foldably connected with the cover (1) and has a pair of oppositely formed second ears (31) which are foldable with respect to the connecting plate (3). The bottom (2) has a base (20) foldably connected with the connecting plate (3), a pair of walls (21) foldably formed on opposite sides of the base (20), a pair of second wings (22) each foldably connected with one of the walls (21), a second front side (23) oppositely formed with respect to the connecting plate (3) and foldably connected with the base (20), and a pair of third ears (24) foldably connected with the second front side (23).

The cover (1) further has a window (13), a retaining hole (14) and an outlet (15) defined thereon. Each one of the pair of second wings (22) has a protrusion (221) formed therewith and the base has a pair of openings (201) oppositely defined thereon each being corresponding to one of the pair of protrusions (221). The second front side (23) of the base (20) has two through holes (231) corresponding to the slot (112) of the first front side (11).

Figure 2:
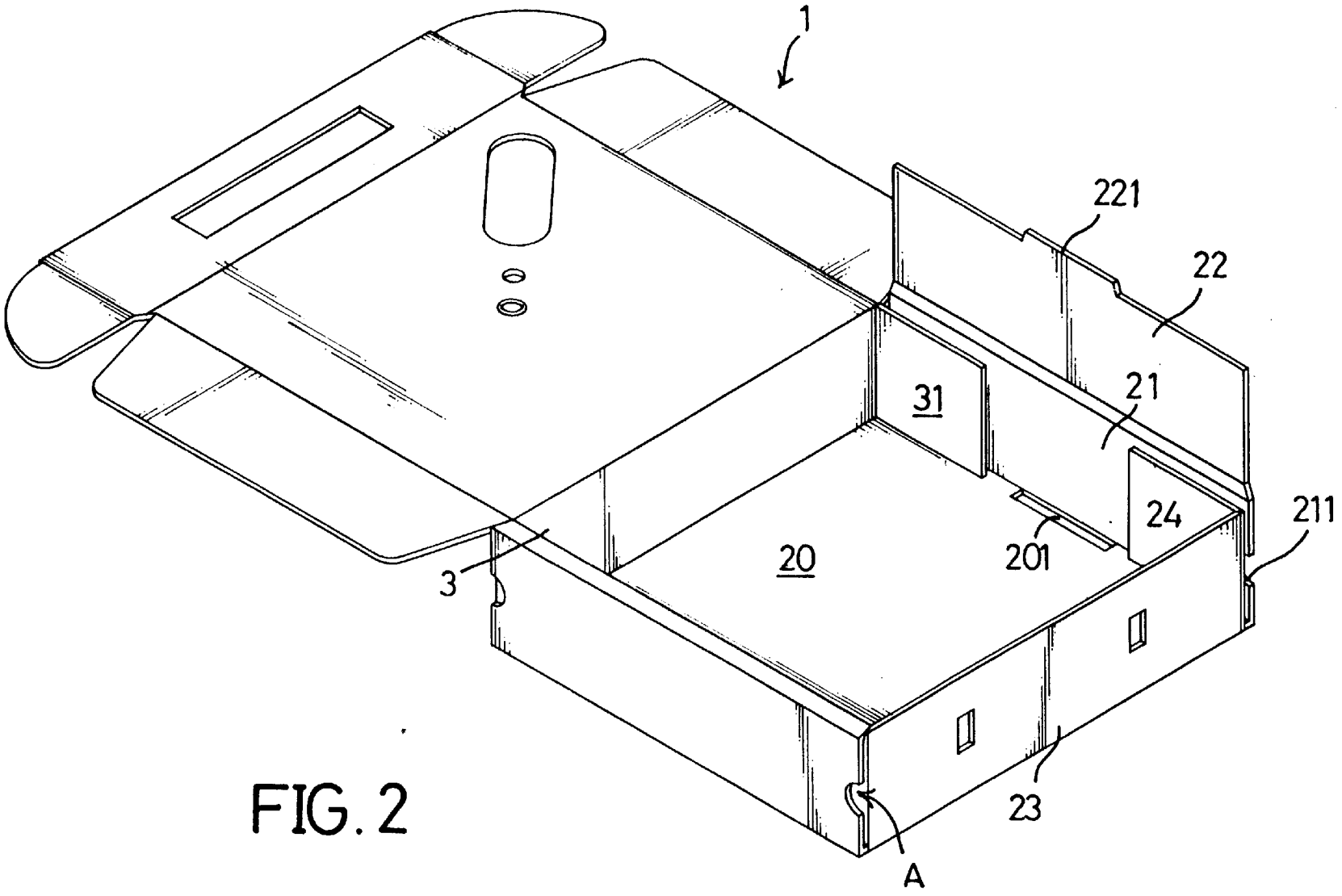
FIGS. 2 and 3 are perspective views showing a first pair of ears and a second pair of ears of the package are oppositely folded and a first front side and a second front side are folded to secure the first and second pair of ears in position.
Figure 3:
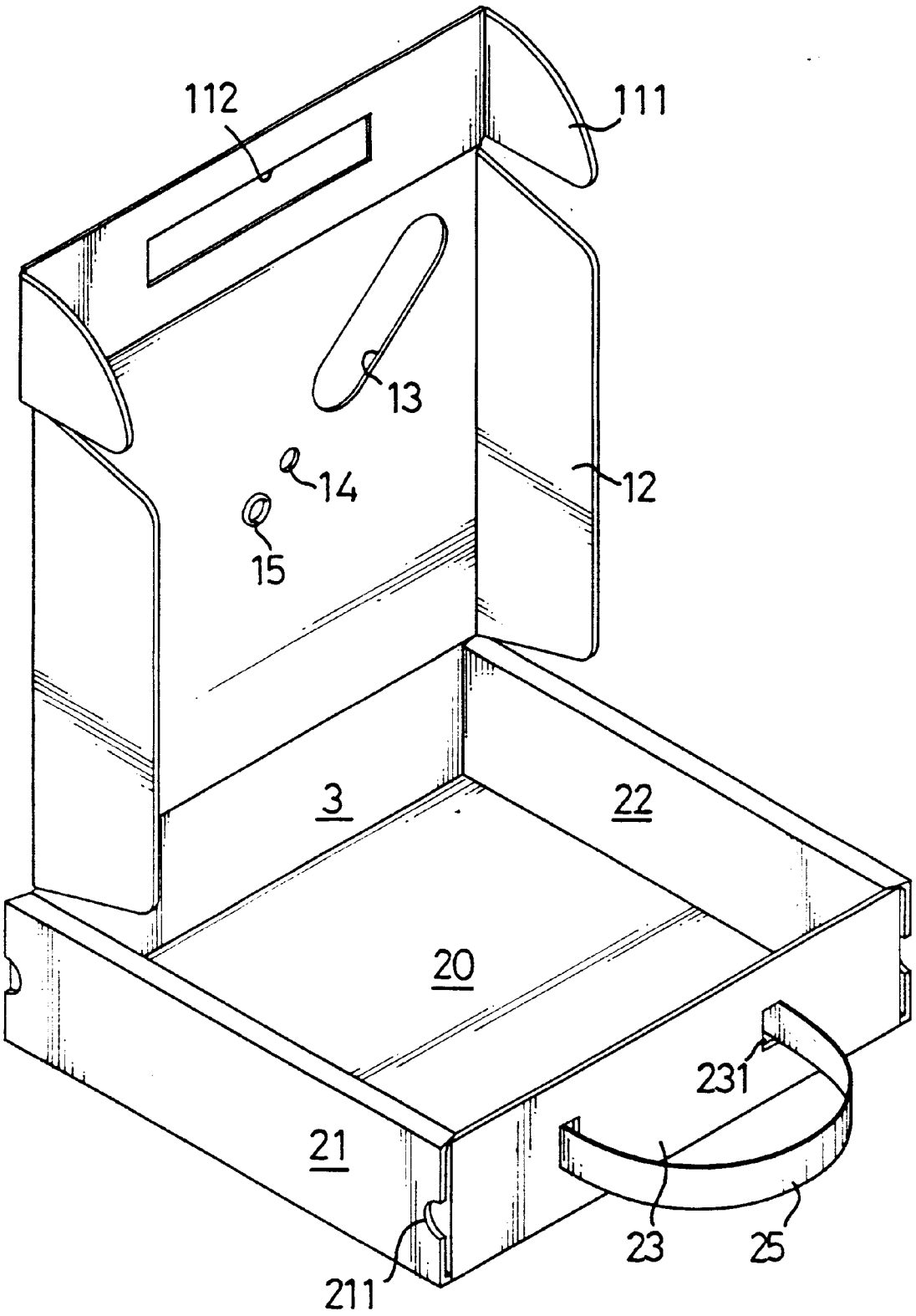

Referring to FIGS. 2 and 3, when the paper board of the package shown in FIG. 1 is in assembly, the connecting plate (3), the pair of walls (21) and the second front side (23) are first set in an upright position with respect to the base (20). Then an operator folds the pair of second ears (31) and the pair of third ears (24) to attach them with an inner face of one of the walls (21) respectively. Then, the pair of second wings (22) are folded with respect to and detachably connected with the respective walls (21) and to enclose the respective one of the pair of second ears (31) and the third ears (24). Afterwards, the respective protrusions (221) of the pair of second wings (22) are inserted into the corresponding openings (201) to secure the enclosure of the pair of second ears (31) and the third ears (24) by the respective second wings (22). It is notable from the drawing that an arcuate cutout (211) is defined in both distal side of the walls (21), such that a passage A is defined between the respective one of the third ears (24) and a face of the respective one of the second wings (22).

Referring again to FIG. 1, it is noted that the size of the base (20), the connecting plate (3) and the cover (1) is sequentially larger than the latter one. Therefore, when the assembly between the base (20) and the connecting plate (3) is accomplished, the first wings (12) of the cover (1) are so configured that they are able to be received in a space defined by the base (20) and the connecting plate (3) and to attach the face of the respective second wings (22).

Figure 4:
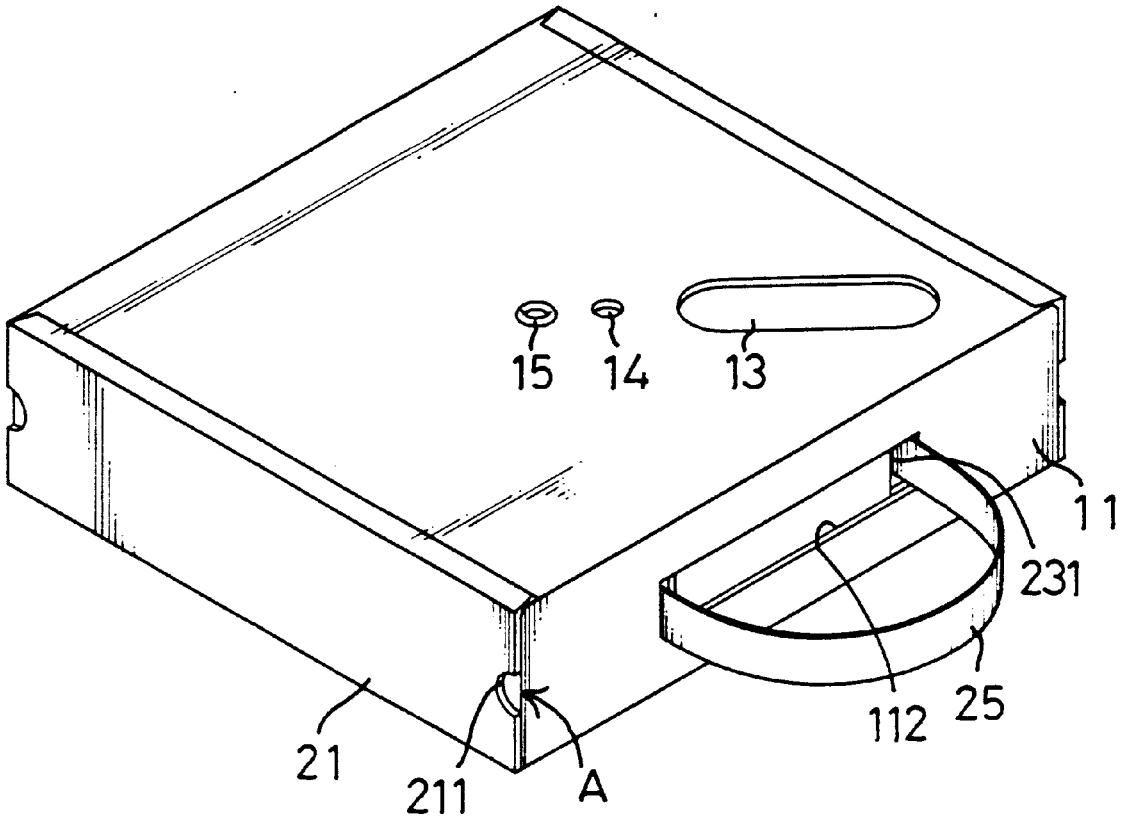
FIG. 4 is a perspective view showing the package of the invention is fully folded.
Figure 5:
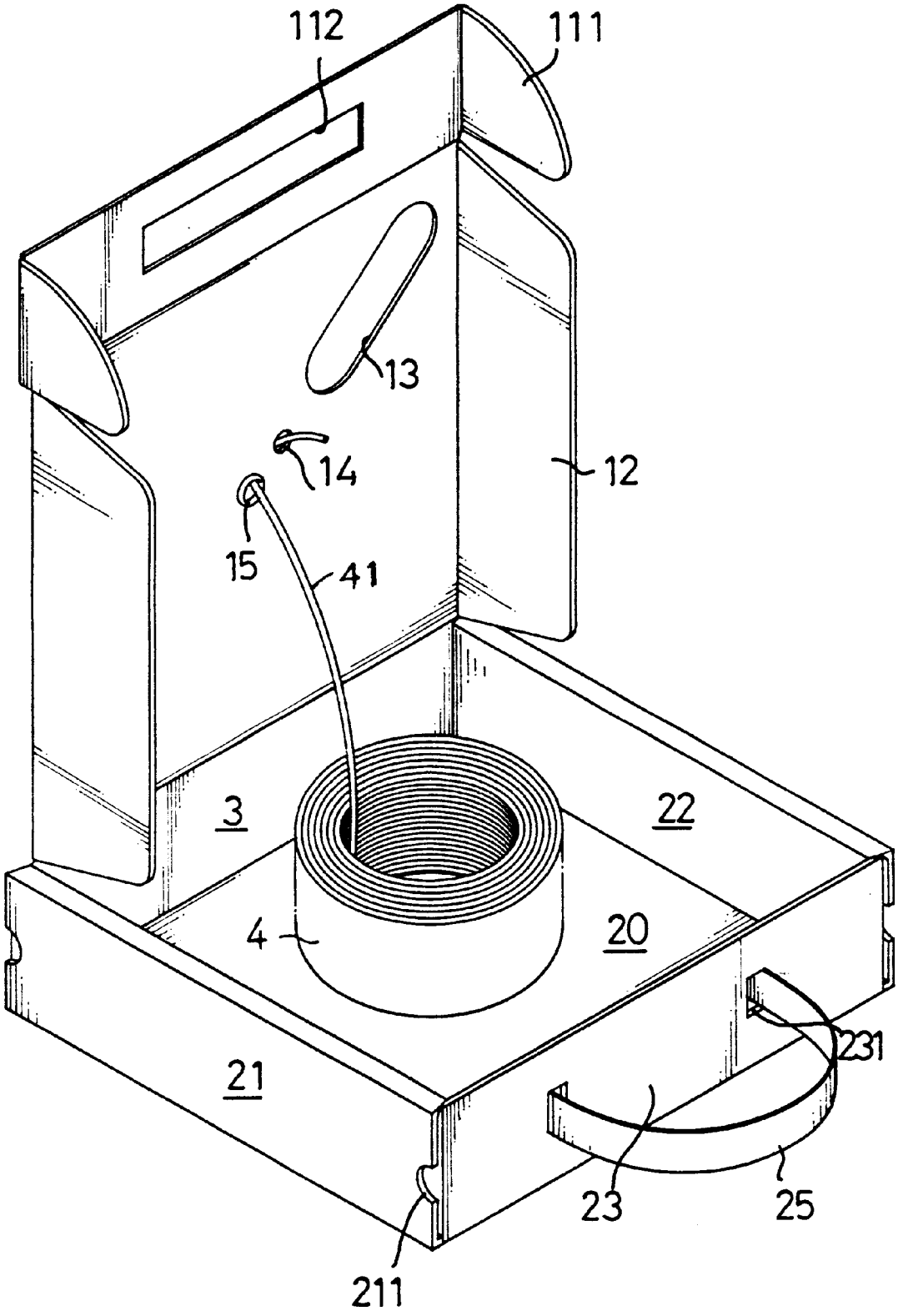
FIG. 5 is an embodiment of the package showing that a reel of wire is received therein and a free end of the wire extends out from an outlet and is retained in a retaining hole of the package.

Referring to FIGS. 3 and 4, when the pair of the second wings (22) is folded and both of the second wings (22) engage the respective wall (21), together with the respective protrusion (221) being inserted into the corresponding openings (201) of the base (20), the operator is able to insert the pair of first wings (12) into the space defined by the pair of second wings (22), the second front side (23) and the connecting plate (3). Afterwards, the pair of first ears (111) are able to be inserted into the corresponding passages A to form a package. Meanwhile, the first front side (11), thus, engages with and covers the second front side (23). A handle (25) is then able to be secured in the corresponding through holes (231) and the slot (112) Referring to FIG. 5, a reel of wire (4) is placed on the base (20) and within the space of the package. A free end (41) of the reel of wire (4) extends out from the inner peripheral thereof through the outlet (15) and is retained by inserting it into the retaining hole (14). It is noted from the description above that when in operation, the operator is able to extend out the free end (41) of the reel of wire (4) through the outlet (15) without destroying the shape of the reel or wire (4). Thus, the reel of wire (4) is able to keep its shape within the package of the invention during operation. After the operator obtains enough length of wire and cuts the wire, the operator is able to insert the free end (41) back into the retaining hole (14), such that the reel of wire (4) is able to keep its shape after operation. When in shipment, the reel of wire (4) being kept in the package of the invention is able to facilitate transportation thereof, and the reel of wire (4) is able to maintain its complete appearance due to the protection of the package.

Furthermore, no matter it is during operation or in storage, the operator is easy to observe the volume of the wire left in the package through the window (13), which reduces the effort and time for the operator to open the package for proceeding of the check. A ruler can be formed or printed beside the window for estimating the length of the wire left therein.

To sum up, the package of the invention has the following advantages:

1. being easy to-assemble and disassemble;
2. facilitating the transportation, storage and observation of a reel of wire;
3. providing protection to the reel of wire at all times;

From the foregoing, it is seen that the objects hereinbefore set forth may readily and efficiently be attained. And since certain changes may be made in the above configuration to create different embodiments of the invention without departing from the scope thereof, it is intended that all matters contained in the above description or shown in the accompanying drawings shall be interpreted as an illustration and in a non-limiting sense.

After the detailed description of the invention, other alternation, modification and/or changes thereof will be obvious to those skilled in the art. Therefore, the scope of the invention should be defined by the appended claims.

What is claimed is:

1. A package for a reel of wire comprising a cover for being detachably covered on a bottom to enclose the reel of wire therein, an outlet defined on a top face of the cover for a free end of the wire to extend out, and a retaining hole defined on the top face of the cover for retaining the free end of the wire;

a connecting plate foldably connected with the cover and having a pair of second ears foldably connected with a connecting plate;

the cover including a first front side having a pair of first ears formed on two opposed sides thereof, a slot defined in a mediate portion thereof, and a pair of first wings foldably connected thereto;

the bottom having a pair of openings defined thereon and including a base foldably connected with the connecting plate, a pair of walls foldably formed on opposite sides of the base, a pair of second wings each foldably connected and detachably connected with each of the walls and each having a protrusion formed to correspond to a respective one of the pair of openings, a second front side oppositely formed with respect to the connecting plate and foldably connected with the base and having a pair of through holes corresponding to the slot of the cover, a pair of third ears foldably connected with the second front side, a handle secured in the corresponding through holes and the slot; and the pair of second ears and the pair of third ears being enclosed by the respective one of the pair of second wings when the pair of second wings are folded with respect to the connecting plate and the pair of third ears are folded with respect to the second front side.

2. The package as claimed in claim 1, wherein the size of the cover, the connecting plate and the bottom is sequentially smaller than the latter one.

3. The package as claimed in claim 1, wherein the cover further includes a window for observation of the reel of the wire.

4. The package as claimed in claim 3, further including a ruler beside the window for estimating the length of the remaining reel of wire.

* * * * *